US006204459B1

(12) United States Patent
Kizele et al.

(10) Patent No.: US 6,204,459 B1
(45) Date of Patent: Mar. 20, 2001

(54) SWITCHING ARRANGEMENT

(75) Inventors: Rainer Kizele; Heinrich Mueller, both of Tuttlingen; Klaus Rapp, Oefingen, all of (DE)

(73) Assignee: Marquardt GmbH, Rietheim-Weilheim (DE)

( * ) Notice: Subject to any disclaimer, the term of this patent is extended or adjusted under 35 U.S.C. 154(b) by 0 days.

(21) Appl. No.: 09/380,158

(22) PCT Filed: May 5, 1998

(86) PCT No.: PCT/DE98/01235

§ 371 Date: Aug. 26, 1999

§ 102(e) Date: Aug. 26, 1999

(87) PCT Pub. No.: WO98/50930

PCT Pub. Date: Nov. 12, 1998

(30) Foreign Application Priority Data

May 7, 1997 (DE) ..... 197 19 245

(51) Int. Cl.[7] ..... H01H 9/04

(52) U.S. Cl. ..... 200/302.1; 200/5 A; 200/5.7; 200/317; 200/302.2

(58) Field of Search ..... 200/5 A, 310, 200/512–517, 302.1, 302.2, 313, 314, 317, 341, 345

(56) References Cited

U.S. PATENT DOCUMENTS

| | | | | |
|---|---|---|---|---|
| 4,641,004 | * | 2/1987 | Kaprda | 200/340 |
| 4,772,769 | * | 9/1988 | Shumate | 200/314 |
| 5,453,586 | | 9/1995 | Stottmann | 200/5 R |
| 5,464,955 | | 11/1995 | Cole | 200/317 |
| 5,704,467 | * | 1/1998 | Jarvis | 200/302.2 |
| 5,734,136 | * | 3/1998 | Newcomer et al. | 200/5 A |
| 6,054,939 | * | 4/2000 | Wei et al. | 341/20 |
| 6,075,214 | * | 6/2000 | Sato et al. | 200/314 |

FOREIGN PATENT DOCUMENTS

| | | | |
|---|---|---|---|
| 29 07 270 | 9/1980 | (DE) | H05K/5/02 |
| 31 11 409 | 10/1982 | (DE) | G02B/5/14 |
| 86 02 882 | 5/1986 | (DE) | H01H/13/06 |
| 89 05 799 | 8/1989 | (DE) | F24C/15/06 |
| 90 11 110 | 11/1990 | (DE) | G05G/1/02 |
| 92 01 985 | 6/1992 | (DE) | B29C/65/58 |
| 41 39 554 | 4/1993 | (DE) | H01H/13/48 |
| 42 12 562 | 10/1993 | (DE) | H01H/13/70 |
| 42 27 468 | 2/1994 | (DE) | H01H/9/18 |
| 44 00 772 | 12/1995 | (DE) | H01H/5/04 |
| 195 03 702 | 8/1996 | (DE) | H01H/9/04 |
| 0 074 315 | 3/1983 | (EP) | B41J/5/12 |
| 0 158 795 | 10/1985 | (EP) | H05K/5/00 |
| 2 208 039 | 2/1989 | (GB) | H01H/13/70 |

OTHER PUBLICATIONS

Schönewald "Schnappverbindungen in der Anwendung". Anwendung und Design, Kunststoffo 79 (1989) 8, pp. 732–737.

* cited by examiner

*Primary Examiner*—Michael Friedhofer
(74) *Attorney, Agent, or Firm*—Venable; Robert Kinberg

(57) ABSTRACT

A switch arrangement, in particular for domestic appliances, such as washing machines, dishwashers or the like has a housing (2) having at least one switching element which is located in the housing interior. At least one operating member is arranged on the housing, in order to act on the switching element in the sense of operating it. Furthermore, the housing has a supporting part, which has a holder for the operating member. The holder in the supporting part has an opening on the side facing the housing interior, which opening is associated with the switching element. A sealing element which is elastic in the movement direction of the operating member is fitted on the opening in the supporting part, between the switching element and the operating member, with the operating member acting on the switching element via the elastic sealing element. The sealing element is molded on the supporting part like a two-component part

15 Claims, 3 Drawing Sheets

SWITCHING ARRANGEMENT

BACKGROUND OF THE INVENTION

The invention relates to a switch arrangement having at least one switching element and one operating member.

Such switch arrangements are used by the user to select functions on electric appliances. Such electric appliances may be domestic appliances, such as washing machines, dryers, dishwashers or the like.

DE 195 03 702 A1 discloses such a switch arrangement having a housing. An inner housing, which is encapsulated and sealed on all sides and in which switching elements are arranged, is located in the housing interior. Operating members are arranged on the housing in order to act on the switching elements in the sense of operating them. The inner housing has a wall in the form of a membrane, which is arranged between the switching elements and the operating members. The operating members act on the switching elements via the wall which is in the form of a membrane and is elastic in the movement direction of the operating members.

The wall in the form of a membrane on the inner housing thus acts as an elastic sealing element between the operating member and the switching element, preventing the ingress of contaminants, such as water, dust or the like, into the housing interior of the switch arrangement. However, manufacture of the inner housing is very complex. Furthermore, the switching elements must be introduced into the inner housing during the actual process of manufacturing it. It is no longer possible to change the number of switching elements retrospectively. It has thus been found to be disadvantageous that the known switch arrangement is not very flexible and cannot easily be adapted to different appliance configurations.

SUMMARY OF THE INVENTION

The invention is based on the object of designing a switch arrangement in such a manner that flexible adaptation to different appliance configurations is possible in a simple manner while, nevertheless, avoiding any damaging influence from contaminants on the switching elements.

The objects of the invention are accomplished by a switch assembly comprising a housing defining an interior and having at least one switching element located in the housing interior. At least one operating member is arranged on the housing and movable in a movement direction to act on the switching element. An elastic sealing element seals the housing interior and is arranged between the switching element and the operating member. The sealing element is elastic in movement direction of the operating member so that the operating member acts on the switching element via the elastic sealing element. The housing has a supporting part arranged in the housing interior. It has a holder for holding the operating member. The holder defines an opening in the supporting part facing the housing interior and associated with the switching element. The sealing element is fitted on the opening and is molded on the supporting part.

It is particularly preferably for a snap-action disk which is used as a switching element to be molded directly onto the holder for the operating member in the supporting part, like a two-component part. In consequence, the switching element itself acts as a sealing element, so that both the switching function and sealing can be achieved by means of a single element. One advantageous development is also for a circumferential seal to be molded onto the supporting part, to provide a seal at the side for the space which accommodates the switching elements, like a two-component part. This can be done using the same tool during the process of molding-on the snap-action disks, if the same material is used for the sealing lip as for the snap-action disk. This thus ensures an excellent seal, despite reducing the number of parts.

In a further particularly advantageous refinement, light conductors are integrated in the supporting part. The supporting part which is used to hold the operating members is then preferably produced from optically transparent plastic. The supporting part can thus at the same time be used for transmitting light in- order to illuminate the function, or the like, of the operating members. Finally, it is also expedient to provide the side of the housing facing the supporting part with conductor tracks, for example as an MID (Molded Interconnected Device) part. The conductor tracks are used as fixed contacts for the snap-action disks, and for producing the required electrical connections for the switching elements.

A switch arrangement having the said developing refinements is essentially composed of two parts. The first part is the housing with the conductor tracks, which is used as the base body for the switch arrangement. The second part is used as the supporting part for the operating members and, as a two-component part, is provided with integrated snap-action disks, seals and light conductors. The second part is then attached, like a cover, to the first part by latching connections, snap-action hooks or the like. After this, this arrangement can also be provided with a covering panel, through which the operating members project. It is immediately evident that the simple design and the small number of parts result in the process of assembling the switch arrangement being simplified.

The advantages achieved by the invention are, in particular, that the space which accommodates the switching elements of the switch arrangement is sealed against the ingress of water, dust or the like at all openings and connection points in a simple manner, so that the switching elements are protected against damaging influences. This considerably improves the risk of premature failure of the switch arrangement, even in severe operating conditions.

Furthermore, various versions of switch arrangements can be produced by the supporting part being provided for the maximum number of operating members as well as switching elements, but being fitted, during the assembly process, only with those operating members and/or switching elements which are actually required for the respective version. This simplifies stockkeeping, and the switch arrangement becomes cheaper overall. Furthermore, the switch arrangement according to the invention achieves improved functionality while at the same time reducing the number of parts in comparison with previous solutions.

Exemplary embodiments of the invention are described in more detail in the following text and are illustrated in the drawings.

DETAILED DESCRIPTION OF THE PREFERRED EMBODIMENTS

Figure 1:
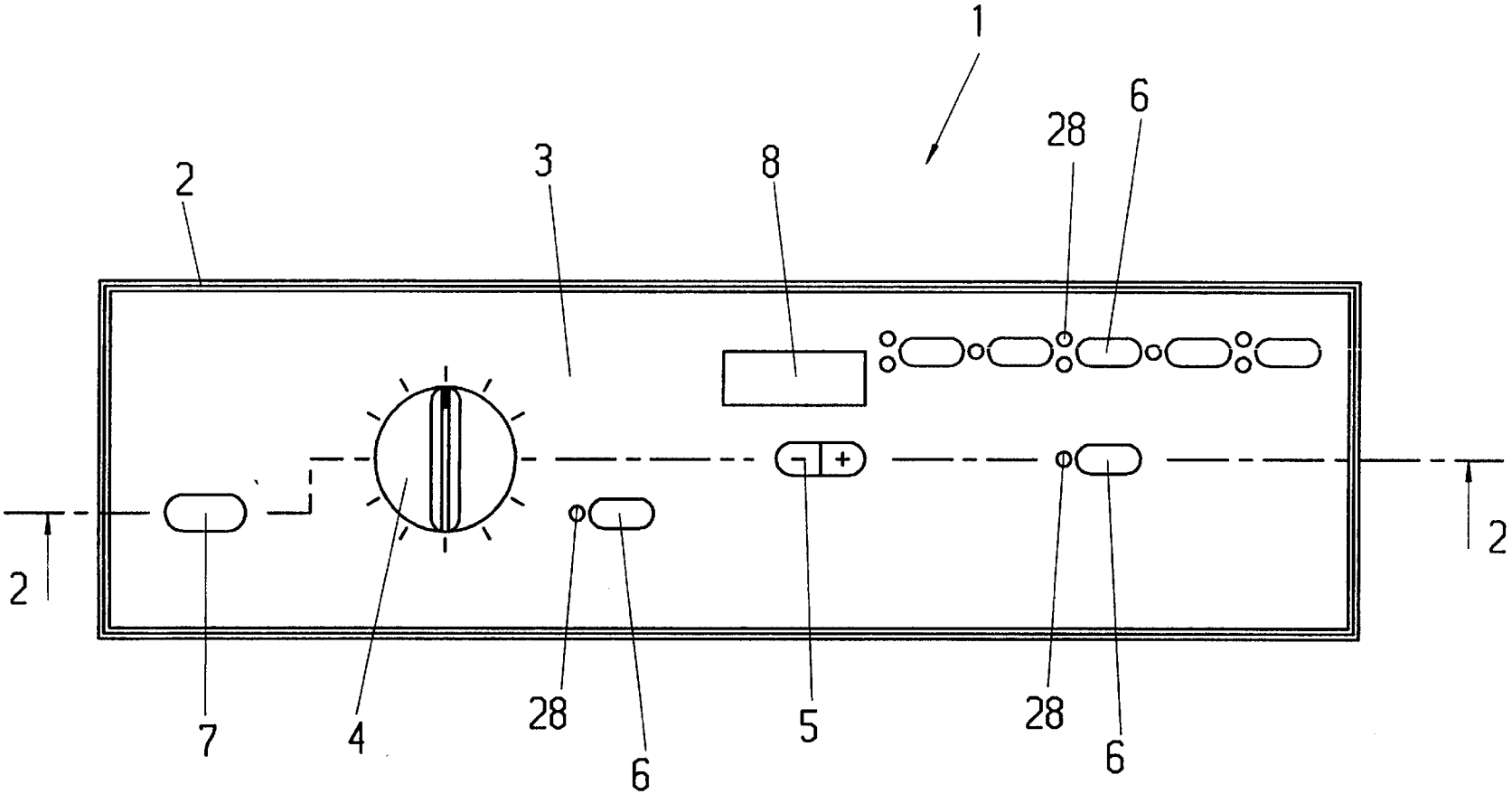
FIG. 1 shows a plan view of a switch arrangement.

FIG. 1 shows a plan view of a switch arrangement 1 for an electrical domestic appliance, which may be, for example, a washing machine or a dishwasher. The switch arrangement 1 has a housing 2 which is provided on the upper face with a panel 3. Operating members 4, 5, 6, 7 which are arranged on the housing 2 project through the panel 3 so that they are manually accessible and the user can use them to select various functions of the electrical domestic appliance. The panel 2 also contains an indicator 8, for example an LED or LCD indicator, in which the operating modes of the domestic appliance are displayed to the user.

Figure 2:
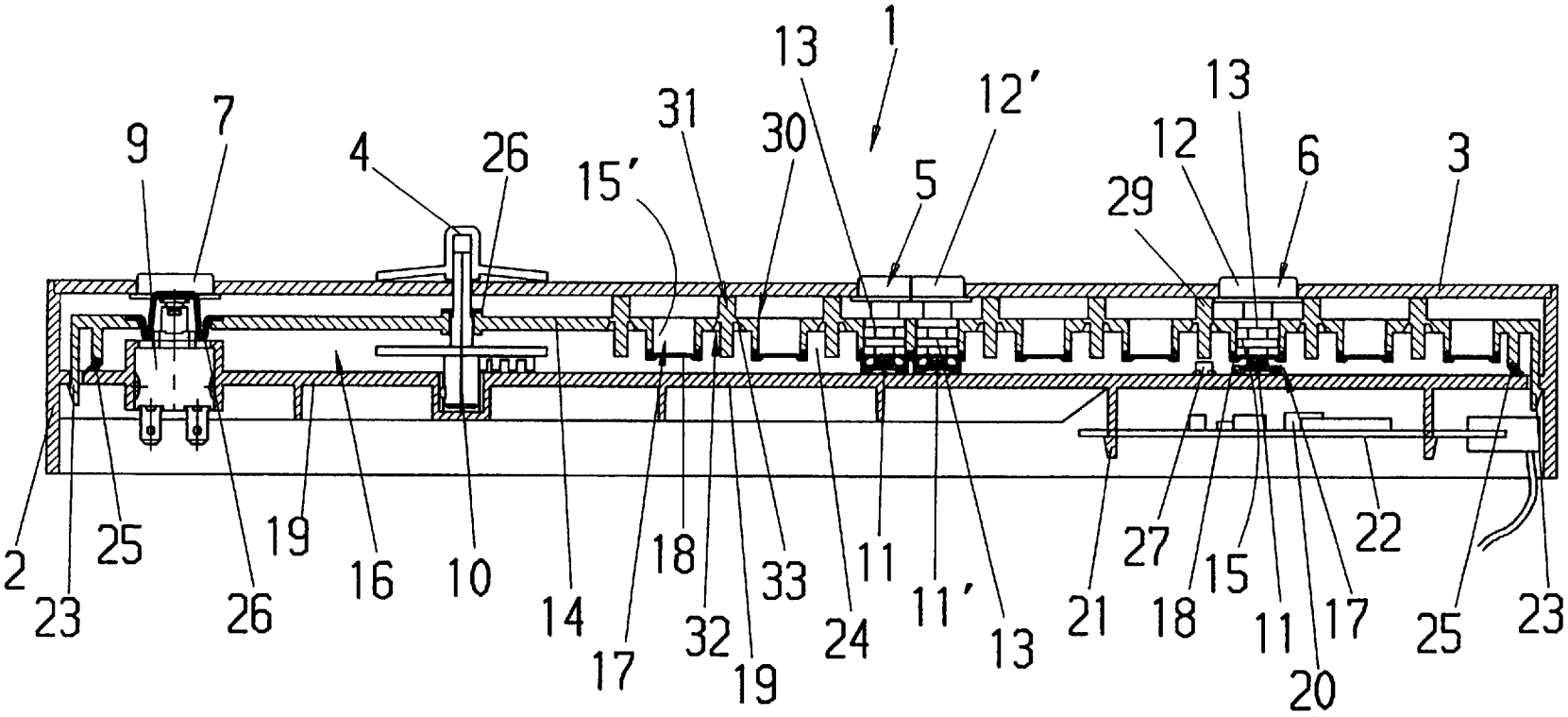
FIG. 2 shows a section along the line 2—2 in FIG. 1.

As can be seen in more detail from FIG. 2, the housing 2 contains switches 9, 10 and switching elements 11, 11' which are associated with the operating members 4, 5, 6, 7. The switch 9 is a mains switch for switching the domestic appliance on and off. The switch 10 is a rotary switch, which can be used to set the respective program for the domestic appliance. Finally, the operating members 5, 6 are used to select various functions on the domestic appliance. The operating member 6 comprises a push button 12 and a plunger 13, and acts on the associated switching element 11 in the sense of operating it. The operating member 5 comprises a rocker 12' which can be moved in two directions and acts on two switching elements 11, 11'. For example, in the case of a washing machine, the temperature can be raised or lowered by means of the operating member 5, and an additional prewash can be selected by means of the operating member 6.

The housing 2 has a supporting part 14, which is preferably arranged in the housing interior 16, as a type of cover. The supporting part 14 may also, of course, be a component of the housing 2, and may also be formed integrally with the housing 2. The supporting part 14 has holders 15, which are designed for example like pots, for the operating members 5, 6. For example, the plunger 13 is mounted in the holder 15, such that it can move in its longitudinal direction. The holder 15 in the supporting part 14 has an opening 17 on the side facing the housing interior 16, which opening 17 is associated with the respective switching element 11, 11'. A sealing element 18 which is elastic in the movement direction of the operating member 5, 6 and is designed like a membrane is fitted to the opening 17 in the supporting part 14, so that the operating member 5, 6 acts on the switching element 11, 11' via the elastic sealing element 18. The housing interior 16 is thus sealed from the outside by the sealing element 18 which is arranged between the switching element 11, 11' and the operating member 5, 6 and is in the form of a membrane, thus effectively preventing the ingress of contaminants, such as water, dust or the like, into the housing interior 16.

In the same way as the housing 2, the supporting part 14 is composed of a hard plastic. This is preferably a thermoplastic, such as polyacrylate, polyamide or the like, so that the supporting part 14 and/or the housing 2 can be produced by injection molding. The sealing element 18 is molded onto the supporting part 14 like a two-component part, with a positively locking connection being produced between the rim on the opening 17 and the sealing element 18. In this case, it is worth selecting an elastic plastic, such as a thermoplastic elastomer, as the material for the sealing element 18, which forms a highly adhesive joint with the plastic for the supporting part 14. A bulk copolymer composed of polybutylene terephthalate and polyether glycol has been found to be particularly suitable for use as the thermoplastic elastomer.

A board 19 which contains the electrical connections is arranged in the housing 2 in order to accommodate the switching elements 11, 11'. It is also worth arranging the mains switch 9 as well as the rotary switch 11 on the board 19. The board 19 may be a conventional printed circuit board. However, the board 19 is preferably in the form of a part of the housing 2, like an MID part. If it is an MID (Molded Interconnected Device) part, this is an injection-molded plastic part on which conductor tracks are located, so that the MID part is used like a printed circuit board to hold electrical and/or electronic components.

In the present case, the board 19 is manufactured integrally with the housing 2 by injection molding, to be precise as a housing closure part on the lower face of the housing 2, associated with the switching element 11, 11'. As already stated, the panel 3 is located opposite this, on the upper face of the housing 2 associated with the operating member 5, 6. The side of the housing closure part which contains the electrical connections for the board 19 faces the housing interior 16. The switching element 11, 11' which is mounted on the board 19 is in the form of a snap-action disk, switch cap or contact element which is composed of plastic, such as a thermoplastic elastomer. Such a snap-action disk, which is provided with a bridging contact, is disklosed, for example, in DE-A 41 12 754. Contact surfaces which are used as fixed contacts and are connected to the conductor tracks are located on the board 19, and the bridging contact in the snap-action disk interacts with them to make contact when the plunger 13 acts on the snap-action disk via the sealing element 18. The conductor tracks may themselves, of course, also be used as fixed contacts.

Furthermore, an electronic circuit 20 is located on and/or in the housing 2 in order to evaluate the switching signals produced by the switching elements 11, 11' and, if appropriate, by the rotary switch 10. The electronic circuit 20 is located on a printed circuit board 22, which is attached by means of snap-action hooks 21 to the board 19 which is used as the housing closure part. The electronic circuit 20 can also convert the switching signals into appropriate electrical signals, such as bus signals or the like. The electrical signals are then transmitted via interface electronics, which are arranged in the electronic circuit 20, between the electronic circuit 20 and other components, such as a microcomputer or the like, in the domestic appliance.

Figure 3:
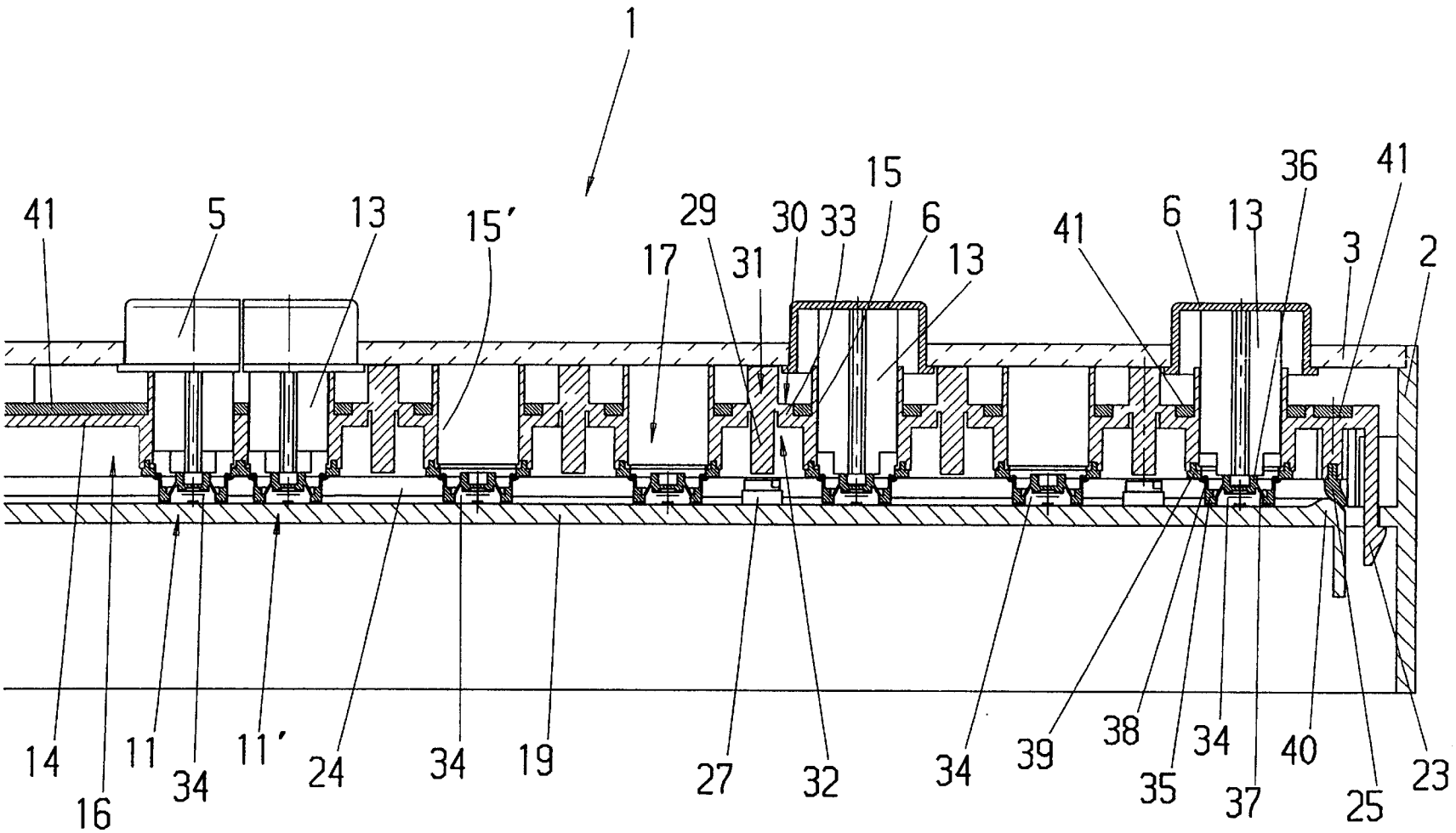
FIG. 3 shows a section as in FIG. 2, but of a different embodiment.

The supporting part 14 is mounted in the housing 2, to be precise on the board 19 there, by means of snap-action hooks 23 or similar latching elements. The switching elements 11, 11' are located in the housing interior 16, to be precise in the space 24 between the supporting part 14 and the board 19. This space 24 is sealed via the sealing elements 18 on the openings 17. An essentially circumferential elastic sealing lip 25 is located on the rim of the supporting part 14, and seals the space 24 at the sides. The sealing lip 25 is likewise composed of a thermoplastic elastomer, like the bulk copolymer mentioned above, and is once again molded on the supporting part 14 like a two-component part. The free surface of the sealing lip 25 rests against the board 19. If required, a raised rim 40, as can be seen in FIG. 3, can be formed as a mating stop surface on the board 19. This prevents any ingress of contaminants into the space 24 and any adverse influence on the switching elements 11, 11'. It should be stressed that such a seal 26 can also be molded on the supporting part 14 in the region of the mains switch 9 and of the rotary switch 10, in order to seal the apertures from the operating member 4, 7 into the housing interior 16.

As can also be seen from FIG. 2, individual holders 15' may be provided in the supporting part 14, in which there is no operating member or associated switching element. This allows various versions of switch arrangements 1 to be produced, by providing the supporting part 14 with holders 15, 15' for the maximum number of operating members 5, 6, and the board 19 to be fitted with the maximum number of switching elements 11, 11'. During assembly, the supporting part 14 and the board 19 are, however, fitted only with those switching elements 11, 11' and operating members 5, 6 which are actually required for the respective version, and the housing 2 is then provided with the panel 3 corresponding to the desired version. Since only one supporting part 14 is required for all versions, this allows a considerable cost saving to be achieved. It should be stressed that the empty holders 15' are also provided with a sealing element 18, thus preventing the ingress of contaminants into the space 24 at these points.

A further exemplary embodiment is shown in FIG. 3. In this case, the snap-action disk 34 which is used as the switching element 11, 11' is molded directly on the opening 17 of the holder 15 like a two-component part. The snap-action disk 34 comprises a base part 35 arranged on the board 19 and a cover 36 which is connected to the base part 35 via an outer surface 37 and projects into the opening 17. The operating member 5, 6 acts via the plunger 13 on the cover 36, in order to operate the snap-action disk 34. A spring-like elastic connecting element 38 is on the one hand connected to the rim of the base part 35, and is on the other hand connected to an attachment element 39, preferably integrally. Spacing tolerances with respect to the board 19 are compensated for by the connecting element 38.

The attachment element 39 is molded on the rim of the opening 17, to be precise on the side facing the housing interior 16. Once again, the molding of the snap-action disk 34 together with that of the attachment element 39 and of the connecting element 38 can be carried out in one operation, at the same time as the molding of the sealing lip 35. The flow channels 41 in the supporting part 14 which are used for the plastic during the molding process to produce the snap-action disk 34 and the sealing lip 25 can be seen in section in FIG. 3, on the side facing the panel 3. The snap-action disk 34 which, including the connecting element 38 and the attachment element 39, is composed of a thermoplastic elastomer such as the bulk copolymer mentioned above, then at the same time acts as a sealing element, so that there is no need for any separate sealing element 18. Once again, holders 15' which have no operating members in them can likewise be provided with molded-on- snap-action disks 34 in order to make it simple to produce different versions.

The supporting part 14 is preferably in the form of a multifunction part which, on the one hand, is used to hold the operating elements 5, 6 in accordance with the above description and, on the other hand, is used to transmit light, which is produced by light elements 27 in the housing interior 16, to the outside of the housing 2. As can be seen in FIG. 1, windows 28 may be arranged for this purpose on the outside of the housing 2, for example on the panel 3. Illumination of the light element 27 can indicate, for example, that the corresponding operating member 5, 6 has been operated.

As can be seen in FIG. 2, the required light elements 27, for example light-emitting diodes, are arranged on the board 19 in the housing 2. In order to pass on the light, a light-conducting rod 29 which is associated with the light element 27 is integrated in the supporting part 14, pointing in the direction of the panel 3. It is particularly preferable for the light-conducting rod 29 to be integrated in the supporting part 14 integrally. For this purpose, the supporting part 14 is composed of a plastic which is largely transparent for light in the visible band. The supporting part 14 then has a first region 30 which runs essentially parallel to the board 13, as well as a second region 31 which is approximately at right angles to the first region 30. The first region 30 contains the holders 15, 15' for the operating members 5, 6, while the second region 31 is used as the actual light-conducting rod 29. The light is thus carried from the light element 27, via the supporting part 14, essentially in the direction of the outside of the housing 2.

In order to avoid the light produced by the light element 27 from being attenuated, the transition 32 between the first region 30 and the second region 31 is now formed in such a way that light which is carried in the second region 31 is substantially impeded from passing into the first region 30. Constrictions 33, depressions or the like may, for example, be used to form such a transition 32. This results in the light being carried in the light-conducting rod 29 to the panel 3, and not being able to emerge, or being able to emerge only to a minor extent, at the side on the intrinsically optically transparent supporting part 14.

The invention is not limited to the described and illustrated exemplary embodiments. In fact, it also covers all developments by a person skilled in the art within the context of the idea of the invention. The invention may thus also be applied to switch arrangements for machine tools, motor vehicles, keyboards or the like.

What is claimed is:

1. A switch assembly for use in an appliance, the switch assembly comprising:

a housing defining an interior and having at least one switching element located in the housing interior;

at least one operating member arranged on the housing and movable in a movement direction to act on the at least one switching element; and an elastic sealing element which seals the housing interior arranged between the at least one switching element and the at least one operating member, the sealing element being elastic in the movement direction of the at least one operating member so that the at least one operating member acts on the at least one switching element via the elastic sealing element, wherein the housing has a supporting part arranged in the housing interior and has a holder for holding the at least one operating member and the holder defines an opening in the supporting part facing the housing interior and associated with the at least one switching element, wherein the sealing element is fitted on the opening, and wherein the sealing element is molded on the supporting part.

2. The switch arrangement as claimed in claim 1, wherein the at least one switching element is a plastic snap-action disk, and is preferably arranged on a board which is located in the housing and contains electric connections, and the snap-action disk is provided with a bridging contact and interacts with fixed contacts arranged on the board to form conductor tracks.

3. The switch arrangement as claimed in claim 1, wherein the switching element is a snap-action disk molded directly on the opening of the holder facing the housing interior so that the snap-action disk acts as a sealing element.

4. The switch arrangement as claimed in claim 1, wherein the holder is fitted with the at least one operating member and wherein the sealing element is molded on the opening, and a snap-action disk is molded on the opening.

5. The switch arrangement as claimed in claim 1, wherein the supporting part is mounted on a board of the housing by means of snap-action hooks and wherein an essentially circumferential elastic sealing lip is located on the supporting part and is molded on the supporting part and the sealing lip seals a space containing the switching element between the supporting part and the board in the housing interior.

6. The switch arrangement as claimed in claim 4, wherein at least one of the sealing element a sealing lip on the supporting part and the snap-action disk is composed of an elastic plastic, and wherein one of the supporting part and the housing is composed of hard plastic.

7. The switch arrangement as claimed in claim 6, wherein the elastic plastic is a thermoplastic elastomer.

8. The switch arrangement as claimed in claim 6, wherein the elastic plastic is a bulk copolymer comprising polybutylene terephthalate and polyether glycol.

9. The switch arrangement as claimed in claim 6, wherein the hard plastic is a thermoplastic.

10. The switch arrangement as claimed in claim 6, where the hard plastic is one of polyacrylate and polyamide.

11. The switch arrangement as claimed in claim 1, wherein the housing has a housing closure part on a lower face thereof, which is associated with the switching element and has a panel on an upper face thereof, which is associated with the operating member and the operating member passes through the panel so that it is accessible manually, and wherein a side of the housing closure part faces the housing interior and has a board comprising an MID (Molded Interconnected Device) part.

12. The switch arrangement as claimed in claim 1, wherein an electronic circuit evaluates switching signals produced by the switching element, and the electrical circuit is located on a printed circuit board attached to the housing and having interface electronics for transmitting electrical signals are arranged on the printed circuit board.

13. The switch arrangement as claimed in claim 1, comprising as least one light element arranged in the housing on a board and a light-conducting rod associated with the light element arranged in the supporting part so that the light from the light element is carried toward the outside of the housing to a window located in a panel of the housing.

14. The switch arrangement as claimed in claim 13, wherein the supporting part is plastic and is substantially transparent to light so that light from the light element is passed via the supporting part to the outside of the housing, and wherein the light-conducting rod is integral with the supporting part.

15. The switch arrangement as claimed in claim 14, wherein the supporting part has a first region arranged essentially parallel to the board and a second region approximately perpendicular to the first region, wherein the first region contains the holder for the operating member, and wherein the second region includes the light-conducting rod and the transition between the first region and the second region is formed, by constrictions so that the passage of the light which is carried in the second region into the first region is significantly impeded.

* * * * *